US007455027B1

(12) United States Patent
Dickerson

(10) Patent No.: US 7,455,027 B1
(45) Date of Patent: Nov. 25, 2008

(54) CONVERTIBLE COVER FOR PONTOON BOATS AND ASSOCIATED METHOD

(76) Inventor: Richard Dickerson, 10931 Woodbrook Dr., Cement City, MI (US) 49233

( * ) Notice: Subject to any disclaimer, the term of this patent is extended or adjusted under 35 U.S.C. 154(b) by 0 days.

(21) Appl. No.: 11/636,330

(22) Filed: Dec. 8, 2006

Related U.S. Application Data

(60) Provisional application No. 60/748,309, filed on Dec. 8, 2005.

(51) Int. Cl.
*B63B 17/02* (2006.01)

(52) U.S. Cl. ..... 114/361

(58) Field of Classification Search ..... 114/361; 135/88.01; 296/105
See application file for complete search history.

(56) References Cited

U.S. PATENT DOCUMENTS

| | | | | |
|---|---|---|---|---|
| 841,719 | A * | 1/1907 | Ross | 114/361 |
| 2,493,833 | A | 10/1950 | Reynolds | |
| 5,070,807 | A | 12/1991 | Lewis | |
| 5,338,084 | A * | 8/1994 | Wardell | 296/105 |
| 5,520,139 | A | 5/1996 | King et al. | |
| 5,718,612 | A | 2/1998 | Elsholz | |
| 6,158,377 | A | 12/2000 | Szukhent, Jr. | |
| 6,260,505 | B1 | 7/2001 | Polidan | |
| 6,681,713 | B2 | 1/2004 | Scott et al. | |
| 7,249,568 | B1 * | 7/2007 | Cultrara | 114/361 |
| 2007/0080557 | A1 * | 4/2007 | Knepper et al. | 296/105 |

* cited by examiner

*Primary Examiner*—Ed Swinehart
(74) *Attorney, Agent, or Firm*—Robert C. Montgomery

(57) ABSTRACT

A convertible cover for pontoon boats comprises a fabric or cloth cover attached to a set of runners. The invention utilizes a track system on both sides of the boat with round runners. Sliding supports with three glide wheels each ride along these runners and match with an equal runner on the opposite side of the boat. The runners glide along a track guide system mounted onto the handrails of the pontoon boat. The cover glides along the track when manipulated by the user and enables the user to effectively and quickly cover the pontoon boat during storage or other times of inactivity. To remove the cover, it is simply pushed backwards where all supports and the tarp are stored at the rear. To deploy, it is simply pulled by a strap to completely and automatically cover the whole boat.

12 Claims, 6 Drawing Sheets

CONVERTIBLE COVER FOR PONTOON BOATS AND ASSOCIATED METHOD

RELATED APPLICATIONS

The present invention was first described in U.S. Provisional Patent No. 60/748,309, filed on Dec. 8, 2005.

FIELD OF THE INVENTION

This invention relates to protective covers for water vessels and, more particularly, to a manually-operated retractable cover assembly for protecting pontoon boats during non-operating conditions.

BACKGROUND OF THE INVENTION

Boating remains one of the favorite pastimes and hobbies for many people. However, as anyone who has ever owned or maintained a boat can attest, they take a great deal of time and money. Much of this time is spent either deploying or removing covers on the boat during periods of non-use. Whether for long term winter storage, or short term storage lasting only a few days, the act of deploying a cover takes a good deal of time. In fact, many boaters skip the covers for short periods of time because they feel it is not simply worth it, which leads to premature aging of the boat and a corresponding decrease in value. Accordingly, there is a need for a means by which boat covers, specifically for pontoon boats can be quickly and easily deployed by one person, no matter how short the storage duration lasts.

Several attempts have been made in the past to develop a manually-operated retractable cover assembly for protecting pontoon boats during non-operating conditions. U.S. Pat. No. 6,260,505 in the name of Polidan discloses a cover system for a pontoon boat having a rail. The cover system includes a framework for receiving a flexible material cover thereon. The framework has hollow end fittings engageable to brackets. Each bracket has a "U"-shaped configuration with inwardly projected protuberances along lateral ends to grasp the underside of the rail. The bracket has a center section between two lateral sections and the center section has a vertically extending portion thereon configured for being received into an end fitting. Unfortunately, this prior art example requires the structure to be affixed to the rails of the pontoon boat in a manner that does not allow the canopy to be moved in a telescoping manner.

U.S. Pat. No. 5,520,139 in the name of King, et al discloses a boat canopy which can be removeably mounted onto the gunwales of a boat, and which can be adjusted forward and backward into various positions. The canopy comprises a canvas top and a plurality of bows which are assembled as one piece, a plurality of leg supports, a plurality of clamps which clamp onto the gunwales, and a plurality of quick-disconnect pins which allow for easy assembly and disassembly. Unfortunately, this prior art example rises to a distance above a boat that does not allow the boat to be maneuvered beneath structures with low openings.

U.S. Pat. No. 5,070,807 in the name of Lewis describes a lightweight, potentially expendable, temporary canopy assembly for small open type watercraft. The thin resilient battens are interconnected in the form of a bowed longitudinal ridge member having a plurality of shorter length, transversely disposed, longitudinally spaced, bowed rib members connected therewith, with the free ends of the battens, inserted through "D"-ring type attachment means provided on the inner periphery of the watercraft, while exerting frictional tension against the craft's gunwales areas. A flexible Nylon type cover comprised of selectively joinable half sections is used as the protective canopy. It uses preferably complementally mateable hooks and loops type manual fastener means, such as Velcro®-complemental fastener strips, to provide the selective attachment and detachment of the two halves over the bowed center ridge member, and also to detachably secure the canopy perimeter portions to the gunwale areas. The canopy half portions are adapted to be furled down from the center ridge and retained against the side gunwale areas by overlaid portions of a preexisting gunwale area peripherally extended safety line or cargo tie down rope. Unfortunately, this prior art example is not suitable for attachment to existing rails found on pontoon-type boats, and does not operate in a telescoping fashion.

U.S. Pat. No. 5,718,612 in the name of Elsholz discloses a portable shelter that provides protection for users of an individual float tube or a pontoon style kick board. The shelter comprises a covering having transparent front panels, transparent side and rear panels, and translucent or opaque lower front panels, side panels and rear panels. A flexible longitudinal rod and transverse rod maintain the dome-like configuration of the shelter. It is easily mounted on the top surface of the tube by using the straps and side straps and by inserting the transverse rod into side pockets that are in turn inserted between the handles and the tube. A rear strap and side straps further secure the shelter to the tube. The front flaps open to provide access for fishing, hunting, photography, and the like, or they may be zipped shut for protection from the elements and greater concealment. Unfortunately, this prior art example is designed for use with individual sized floatation devices, and is not suitable for attachment to pontoon sized boats.

None of the prior art particularly describes a manually-operated retractable cover assembly for protecting pontoon boats during non-operating conditions. Accordingly, there is a need for an assembly which provides such features while overcoming the above-noted shortcomings.

SUMMARY OF THE INVENTION

In view of the foregoing disadvantages inherent in the prior art, it has been observed that there is need for a manually-operated retractable cover assembly for protecting pontoon boats during non-operating conditions.

A protective assembly for covering a pontoon boat includes a cover suitably sized and shaped for covering an entire top surface of the pontoon boat and a track guiding system secured to the top surface of the pontoon boat. Such a cover is operably coupled to the track guiding system, which is essential such that a user can readily adapt the cover between extended and retracted positions. The telescoping element of the cover allows a user to expose only that portion of the boat desired by selectively extending or retracting the cover as needed. The cover includes a plurality of sleeves concentrically positioned about the support poles respectively, and a flexible strap located on a leading edge of the cover, which is necessary for thereby enabling a user to advantageously manipulate the cover and the support poles along the track guides and into a desired position. Such sleeves run widthwise from side to side on a bottom surface of the cover and extend along an entire width of the pontoon boat, which is vital such that the cover encloses an entire top surface of the pontoon boat when in the extended position.

Such a track guiding system includes a plurality of track guides statically mounted to port and starboard handrails of the pontoon boat, and a plurality of runner assemblies slidably and telescopically adapted along the track guides when the cover is biased to the extended and retracted positions. Such runner assemblies remain spaced above the port and starboard handrails of the pontoon boat, which is important such that the cover is smoothly biased between extended and retracted positions without being impeded by the handrails. The runner assemblies maintain direct communication with the track guides, without the use of intervening elements, which is critical such that the cover is advantageously prohibited from undesirably oscillating along a travel path defined non-parallel to respective longitudinal lengths of the track guides respectively. Such prevention of undesirable oscillating allows the cover to be smoothly extended and retracted along the guide tracks without the cover bunching and twisting about the runner assemblies.

The track guide system further includes a plurality of track guide mounts directly coupled to the track guides and the port and starboard handrails respectively, without the use of intervening elements, and a plurality of runner stops directly coupled to opposed ends of the track guides, respectively, without the use of intervening elements. Such runner stops maintain the track guides statically attached to the port and starboard handrails respectively and prevent the runner assemblies from becoming undesirably disengaged from the track guides during extending and retracting procedures. Each of the track guides have linear longitudinal lengths extending parallel to the port and starboard handrails respectively, which is vital such that the cover extends along an entire length of the pontoon boat in the extended position. The track guide mounts are juxtaposed along the longitudinal length of the track guides and extend downwardly therefrom, which is crucial such that the track guide mounts do not interfere with the runner assemblies as the runner assemblies are linearly biased along the track guides.

Each of the runner assemblies includes a runner cover that has a triangular shape provided with opposed corners equidistantly spaced from a center thereof. A plurality of wheels is rotatably coupled to the opposed corners respectively, and a support pole is directly attached to a top one of the opposed corners, without the use of intervening elements. Each of the support poles has opposed ends directly coupled to a corresponding one of the runner assemblies, without the use of intervening elements, and are coextensively shaped and extend along an entire width of the pontoon boat.

First and second ones of the wheels are directly engaged with a bottom surface of the track guides and a third one of the wheels runs on top of the track guides respectively, without the use of intervening elements, which is vital such that the runner assemblies are advantageously prohibited from oscillating along a non-parallel direction to the track guide. This allows the runner assemblies to be smoothly biased along the track guides while the cover is retracted and extended respectively. Each of the runner assemblies further includes an anchoring clamp maintaining the cover at a substantially stable position with respect to the track guides. Such an anchoring clamp has a clamshell shape firmly clamping between an associated one of the track guides and the support poles respectively.

The low height of the cover while in use combined with the telescoping element of the assembly provides the unexpected benefits of allowing a user to move a covered boat beneath low hanging obstacles, and to expose only a selected portion of the top surface of a boat as desired, thereby overcoming prior art shortcomings.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
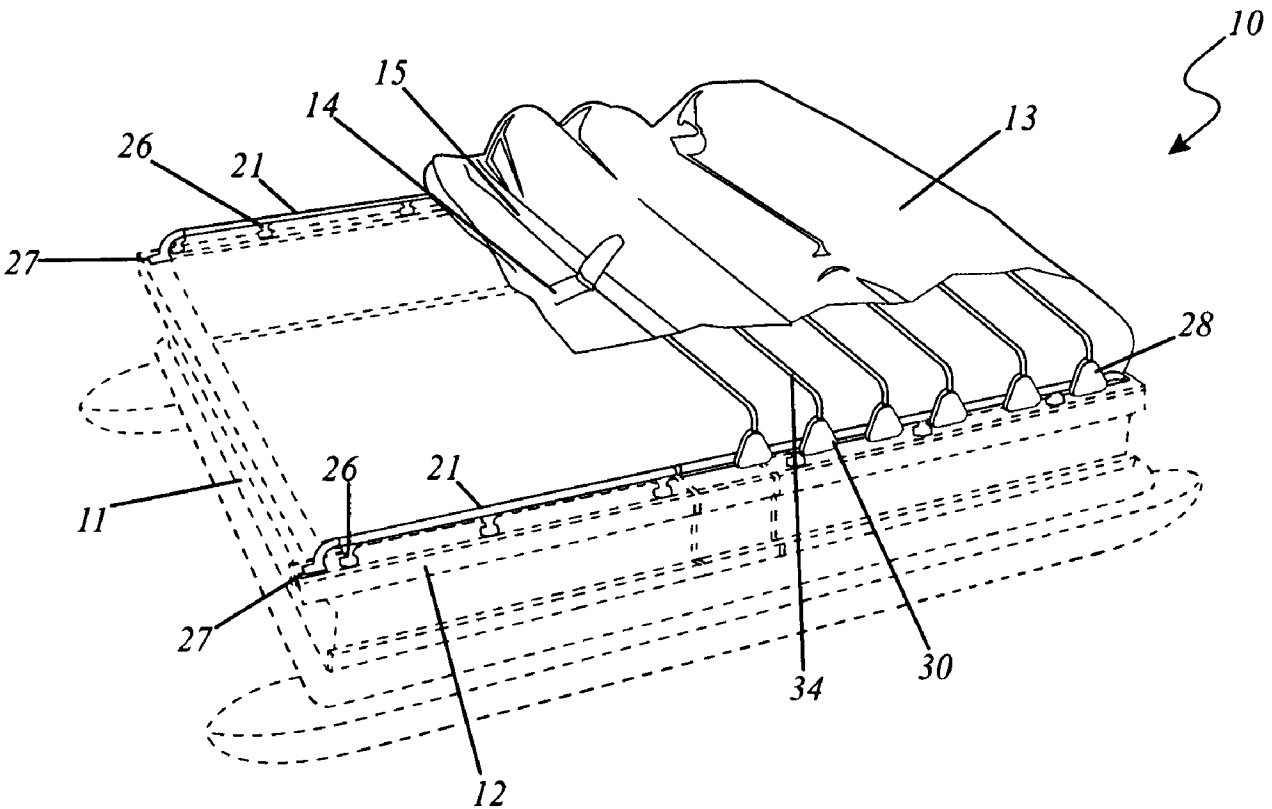
FIG. 1 is a perspective view of the convertible cover for pontoon boats 10, according to a preferred embodiment of the present invention.

10 convertible cover for pontoon boats
11 boat
12 handrail
13 cover
14 strap
15 sleeves
16 tie downs
20 track guide system
21 track guide
26 track guide mount
27 runner stops
28 anchoring clamp
30 runner assembly
32 runner cover
33 wheel
34 cover support pole

DETAILED DESCRIPTION OF THE PREFERRED EMBODIMENT

The best mode for carrying out the invention is presented in terms of its preferred embodiment, herein depicted within FIGS. 1 through 6. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes an apparatus and method for a convertible covering device for pontoon boats 10 (herein described as the "apparatus") 10 by providing a means to quickly and effectively cover a pontoon boat. The apparatus 10 comprises a fabric or cloth cover 13 attached to a set of runner assemblies 30 and, more particularly, runner assemblies 30 that glide along a track guide 21 mounted onto the handrails 12 of the pontoon boat 11. The apparatus 10 when manipulated by the user provides quick and effective covering of said pontoon boat 11 as needed. The apparatus 10 is envisioned to be made up of materials that are both durable and resistant to corrosion resulting from exposure to salt water. The apparatus 10 can be easily reconfigured and manufactured to fit a variety of pontoon boats with differing lengths and widths.

Referring now to FIG. 1, the apparatus 10, according to the preferred embodiment of the present invention, is disclosed. The apparatus 10 comprises the cover 13, runner assemblies 30, track guides 21, and track guide mounts 26. The cover 13 comprises sleeves 15 and a strap 14. The cover 13 is envisioned to be made of heavy-duty and weather-resistant materials, such as, but not limited to, vinyl, canvas, plastics, and the like. The cover 13 is further envisioned to be manufactured in a variety of sizes to fit most conventional pontoon boats 11. The cover 13 is affixed to the aft of the boat 11 and held stationary via an anchoring clamp 28. The sleeves 15 run widthwise from side to side on the bottom surface of the cover 13. The strap 14 is envisioned to be located on the leading edge of the cover 13 and enables the user to manipulate the cover 13 along the track guides 21 and into the desired position.

Figure 2:
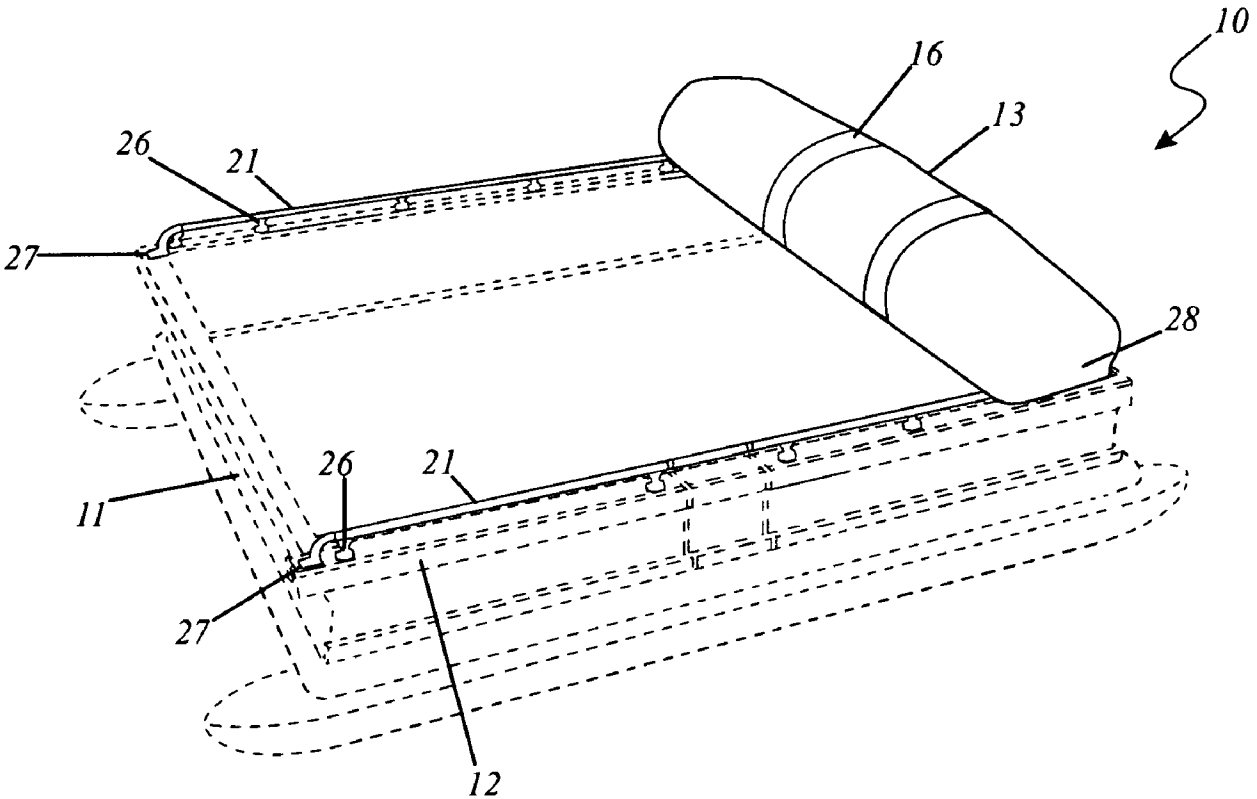
FIG. 2 is a perspective view of the convertible cover for pontoon boats 10, according to a preferred embodiment of the present invention.

Referring now to FIG. 2, the apparatus 10, according to the preferred embodiment of the present invention, is disclosed. Illustrated herein is the cover 13 in a stored position at the aft end of the pontoon boat 11. With the cover 13 in the stored position, two (2) or more tie downs 16 are used to secure the cover 13.

Figure 3:
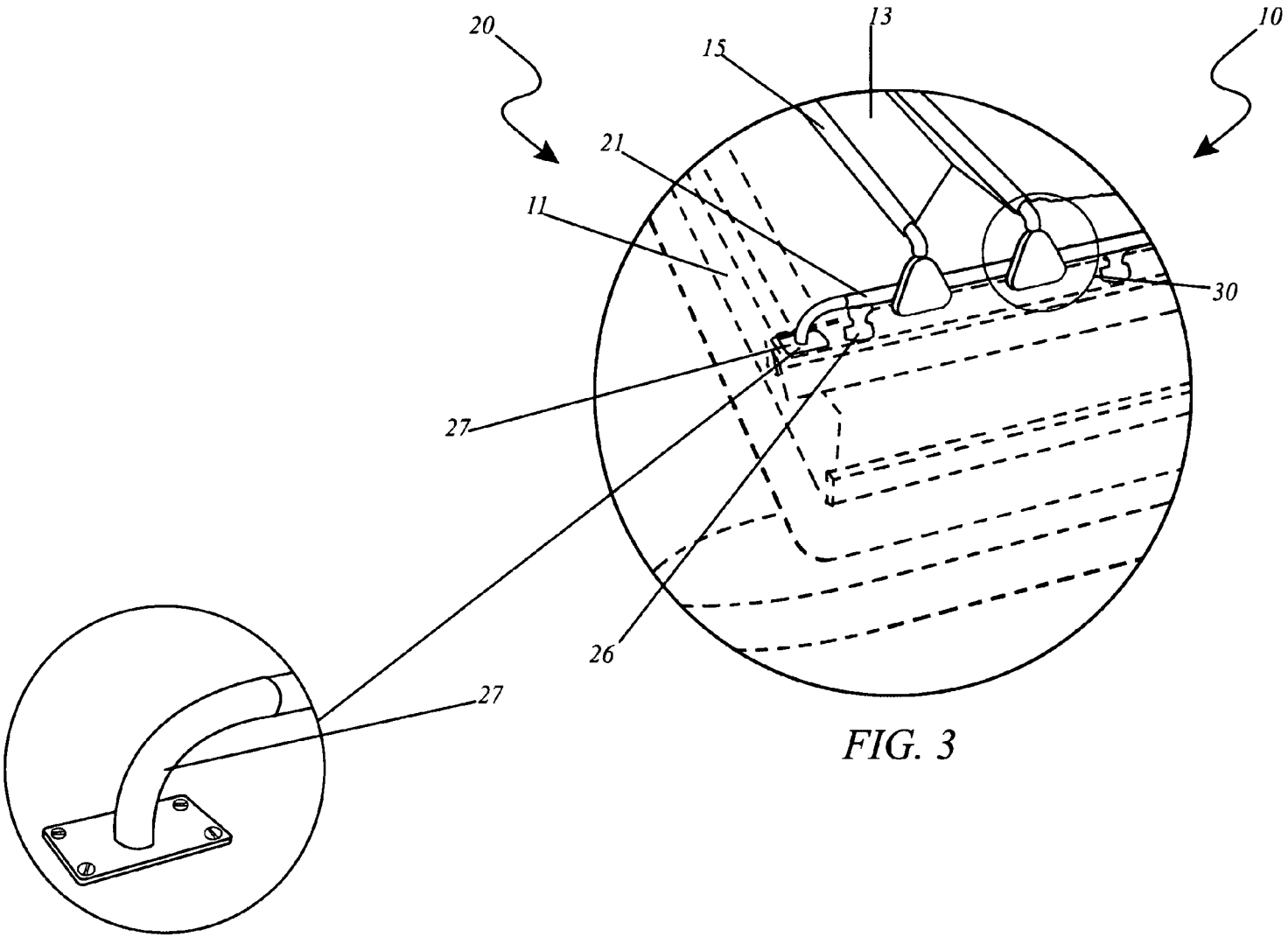
FIG. 3 is a close-up view of the track guide system 20 of the convertible cover for pontoon boats 10, according to a preferred embodiment of the present invention.

Referring now to FIG. 3, a close-up view of the track guide system 20 of the apparatus 10, according to the preferred embodiment of the present invention, is disclosed. The track guide system 20 of the apparatus 10 is illustrated, comprising at least two (2) track guides 21, support mounts 26, runner stops 27, runner assemblies 30, and anchoring clamps 28. The track guides 21 can be made of, but are not limited to, solid bar stock or hollow metal pipes to minimize the weight of the track system. The length of the track guides 21 can be easily customized and are envisioned to be at least as long as the handrails 12 of the boat 11 and are mounted on both port and starboard handrails 12 via the track guide mounts 26.

It is envisioned that, multiple track guide sections 21 may be mounted where there are port or starboard side doors included as part of the handrail 12. The track guide mounts 26 are envisioned to be anchored equidistantly along the track guide 21 at various distances, envisioned to be, approximately three (3) to four (4) feet. The track guide mounts 26 are affixed to the handrail 12 and the track guide 21 by attachment methods, such as, but not limited to, screws, bolts, rivets, and the like. The track guide mounts 26 are envisioned to be, but not limited to, an "Z"-shaped design and can be fabricated using such resilient material as, but not limited to, angle iron, stainless steel, or the like. The track guide mounts 26 are envisioned to be affixed to the track guide 21 using such attachment methods as, but not limited to, welds, screws, bolts, and the like. The track guide mounts 26 are further envisioned to be designed such that they do not interfere with the runner assemblies 30 as they move along the track guides 21. At the extreme ends of the track guides 21 runner stops 27 are provided and mounted to the handrail 12 to prevent the runner assemblies 30 from being detached from the track guides 21.

Figure 4:
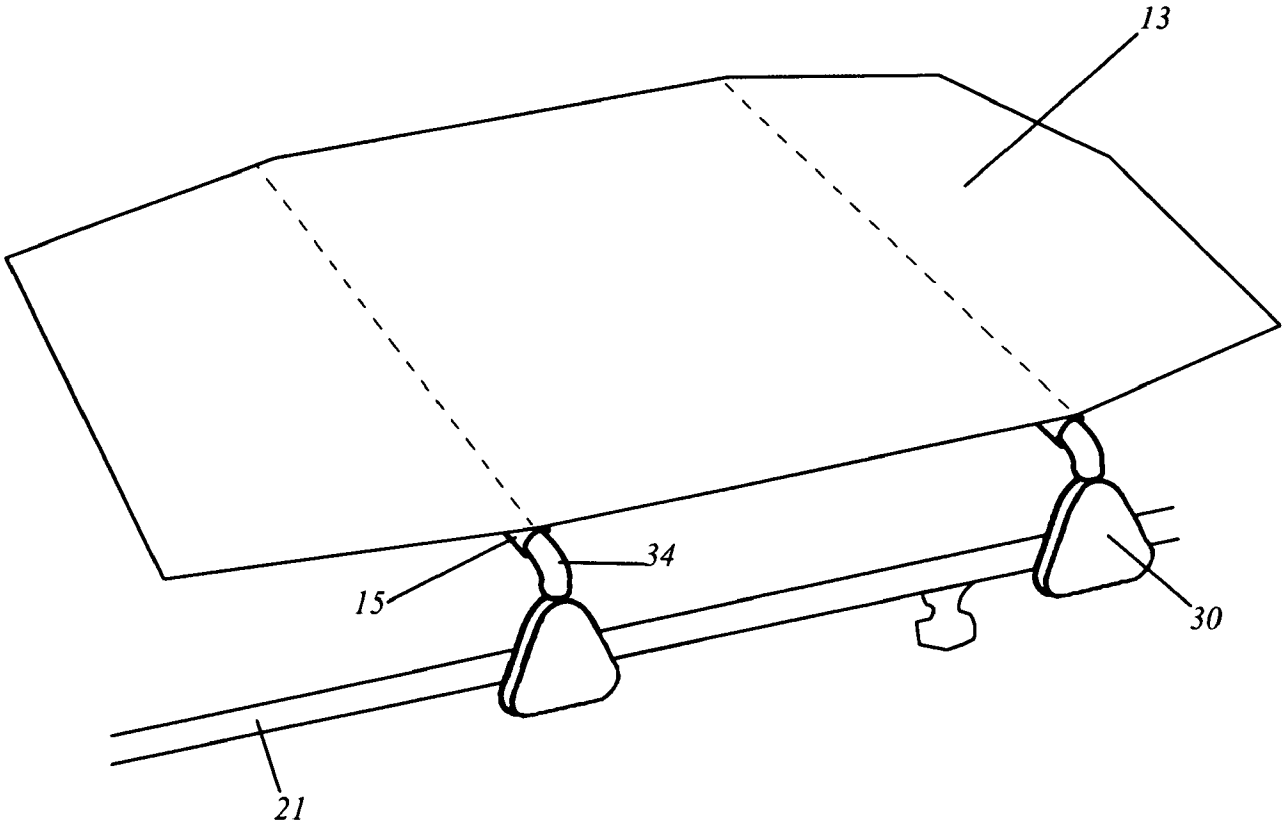
FIG. 4 is a close-up view of the sleeves 15 for the convertible cover for pontoon boats 10, according to a preferred embodiment of the present invention.

Referring now to FIG. 4, a close-up view of the sleeves 15 portion of the apparatus 10, according to the preferred embodiment of the present invention, is disclosed. The sleeves 15 run widthwise from side to side of the cover 13. The sleeves 15 comprise a sewn-in type of construction with the sleeve 15 protruding from the bottom surface of the cover 13. The sleeves 15 are envisioned to be made of, but not limited to, the same durable and lightweight material as the cover 13. The sleeves 15 are further envisioned to be sized to receive the cover support poles 34.

Figure 5:
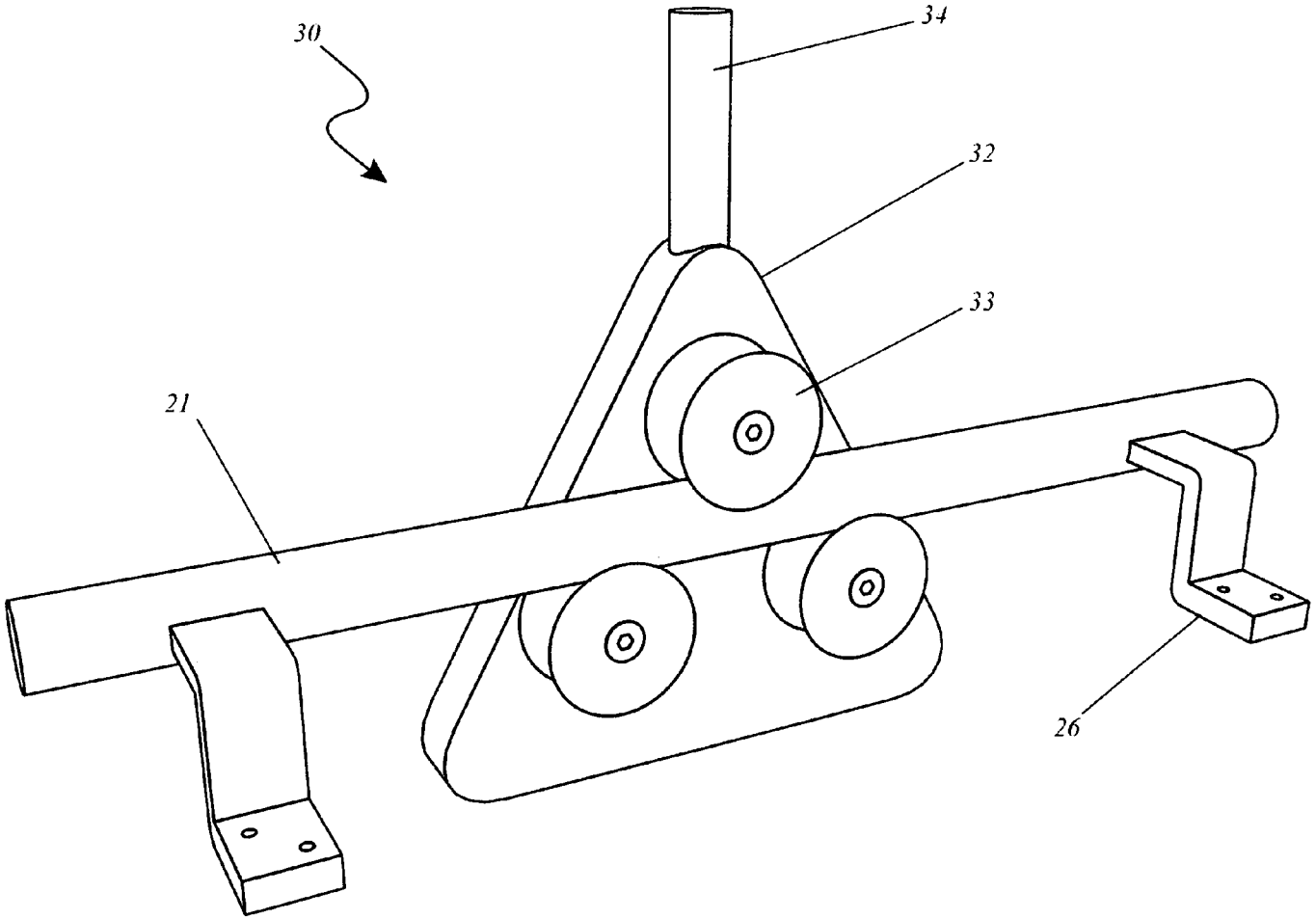
FIG. 5 is a close-up view of the runner assembly 30 of the convertible cover for pontoon boats 10, according to a preferred embodiment of the present invention; and, FIG. 6 is a close-up view of the anchoring clamp 28 portion of the convertible cover for pontoon boats 10, according to a preferred embodiment of the present invention.

Referring now to FIG. 5, a close-up view of the runner assembly 30 portion of the apparatus 10, according to the preferred embodiment of the present invention, is disclosed. The viewing angle for FIG. 5 is from the interior of the boat 11 looking outward, showing the configuration of the runner assembly 30. The runner assembly comprises a runner cover 32, three (3) wheels 33, and cover support pole 34. The runner cover 32 is envisioned to be triangular in shape with rounded corners and three (3) wheels 33 affixed in the corners of the runner cover 32 such that they may rotate freely. The wheels are envisioned such that two (2) wheels 33 run below the track guide 21 and a third wheel 33 runs on top of the track guide 21.

The wheels 33 are further envisioned to capture the track guide 21 from the top and bottom in such a way as to control any relative motion not parallel to the track guide 21. The wheels 33 are also envisioned to be sized large enough to engage the track guide 21 and bridge any gap between two (2) track guide sections 21 while in travel and also to ride over the track guide mounts 26 without interference or travel interruption. The wheels 33 are also envisioned to contain integral bearings to allow relatively frictionless rotation along the track guide 21.

In one (1) corner of the runner assembly 30 is a cover support pole 34' that supports the cover 13. The cover support pole 34 is envisioned to be inserted into a female feature contained in the runner cover design 32. The cover support pole 34 extends outward and when properly oriented, stands directly upward from the top corner of the runner cover 32 adjacent to the top wheel 33. All the components of the runner assembly 30 including the cover support pole 34 are envisioned to be made of materials that are resilient, durable, lightweight, and resistant to corrosion resulting from exposure to salt water, and such.

Figure 6:
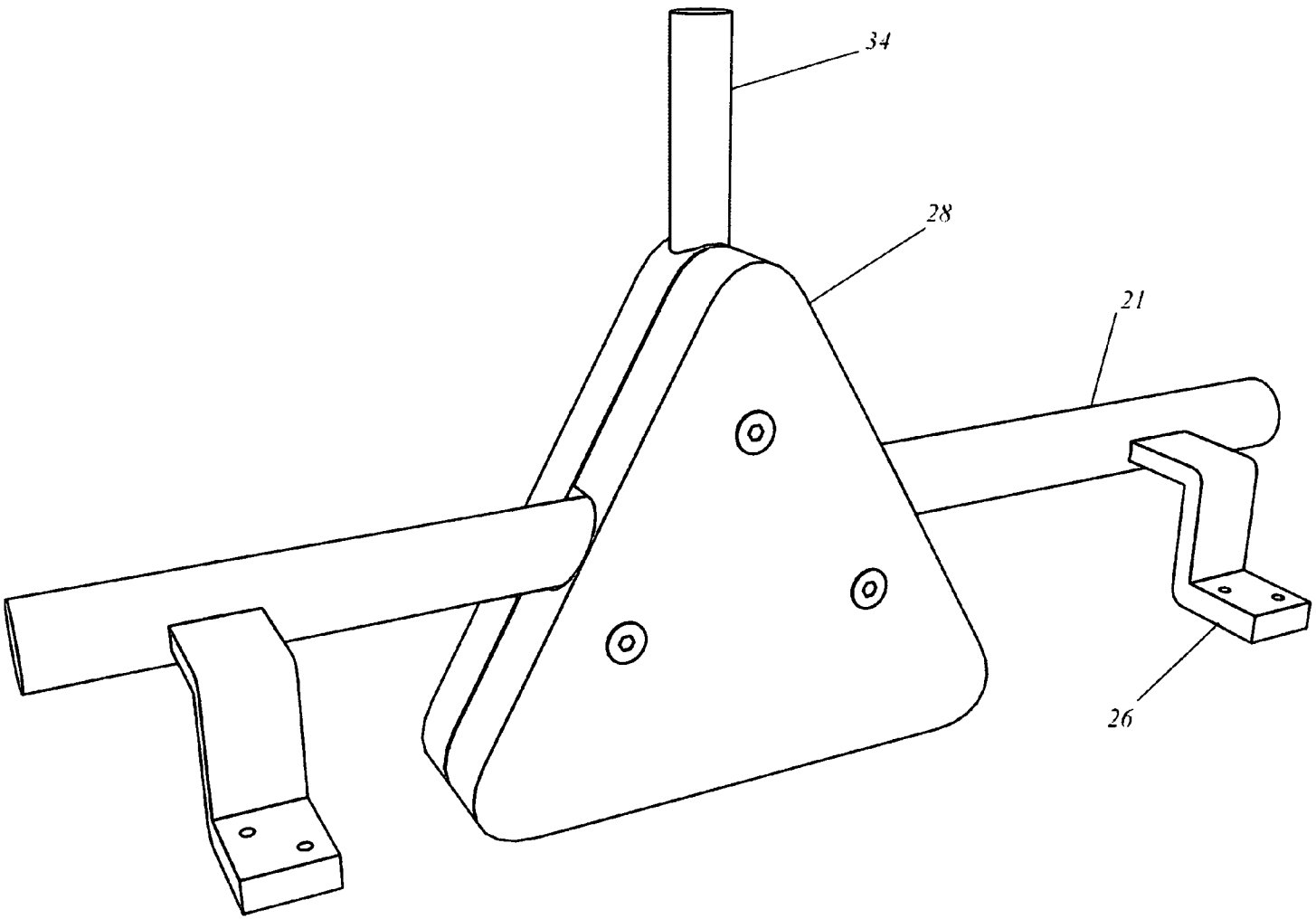

Referring now to FIG. 6, a close-up view of the anchoring clamp 28 portion of the apparatus 10, according to the preferred embodiment of the present invention, is disclosed. The anchoring clamp 28 provides a stationary end for the cover 13 during installation and storage at the aft end of the pontoon boat. The anchoring clamp 28 is envisioned to be of a clamshell design to act as a firm clamp between the track guide 21 and the cover support pole 34 in the aft position.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIG. 1.

The method of installing the apparatus 10 may be achieved by performing the following steps: mounting the track guide mounts 26 by attaching to both the port and starboard handrails 12 at equidistant intervals; determining whether or not there are doors or other breaks in the handrail 12, thereby determining the correct number and length of track guide sections 21 needed; sizing and attaching track guide sections 21 to the track guide mounts 26; rolling the runner assemblies 30 onto the track guide 21 taking care to insure proper orientation of the runner assemblies 30; mounting and installing the runner stops 27 at the fore and aft ends of the track guides 21; installing the anchoring clamps 28 at the aft end of the track guides 21; affixing the cover 13 to the stationary cover support pole 34 located at the aft of the pontoon boat using the sleeves 15 and anchoring clamps 28; affixing the cover 13 to the remaining cover support poles 34 via insertion into the sleeves 15; grasping the strap 14 and walking toward the fore of the boat 11, allowing the runner assemblies 30 to roll among the track guides 21 and carry the cover 13 over the entire pontoon boat 11. At this point the apparatus 10 is properly installed.

The method of uncovering the boat 11 and storing the apparatus 10 may be achieved by performing the following steps: grasping the strap 14 and walking from the fore to the aft thereby allowing the runner assemblies 30, the cover 13, and the support poles 34 to travel down the track guide 21 to the stationary end of the apparatus 10 much like an automobile convertible cover; securing the cover 13 with tie-downs 16 to prevent the cover 13 from unwanted travel towards the fore of the boat 11.

An alternative embodiment of the present invention 10 comprises an additional fabric skirt applied to the entire perimeter of the cover 13 to provide additional protection of the pontoon boat 11.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A protective assembly for covering a pontoon boat, said protective assembly comprising:

a cover suitably sized and shaped for covering an entire top surface of the pontoon boat;

a track guiding system secured to the top surface of the pontoon boat, said cover being operably coupled to said track guiding system such that a user can readily adapt said cover between extended and retracted positions, said track guiding system comprising:

a plurality of track guides statically mounted to port and starboard handrails of the pontoon boat; and, a plurality of runner assemblies slidably and telescopically adapted along said track guides when said cover is biased to the extended and retracted positions;

wherein said runner assemblies maintain direct communication with said track guides such that said cover is prohibited from undesirably oscillating along a travel path defined non-parallel to respective longitudinal lengths of said track guides respectively;

wherein said track guide system further comprises:

a plurality of track guide mounts directly coupled to said track guides and the port and starboard handrails respectively; and, a plurality of runner stops directly coupled to opposed ends of said track guides respectively said runner stops maintaining said track guides statically attached to the port and starboard handrails respectively;

wherein each of said track guides have linear longitudinal lengths extending parallel to the port and starboard handrails respectively; and, wherein said track guide mounts are juxtaposed along the longitudinal length of said track guides and extend downwardly therefrom such that said track guide mounts do not interfere with said runner assemblies as said runner assemblies are linearly biased along said track guides.

2. The protective assembly of claim 1, wherein each of said runner assemblies comprises:

a runner cover having a triangular shape provided with opposed corners equidistantly spaced from a center thereof;

a plurality of wheels rotatably coupled to said opposed corners respectively; and, a support pole directly attached to a top one of said opposed corners;

wherein first and second ones of said wheels are directly engaged with a bottom surface of said track guides and a third one of said wheels runs on top of said track guides respectively such that said runner assemblies are prohibited from oscillating along a non-parallel direction to said track guide.

3. The protective assembly of claim 2, wherein each of said support poles has opposed ends directly coupled to a corresponding one of said runner assemblies, said support poles being coextensively shaped and extending along an entire width of the pontoon boat.

4. The protective assembly of claim 2, wherein each of said runner assemblies further comprises:

an anchoring clamp maintaining said cover at a substantially stable position with respect to said track guides, said anchoring clamp having a clamshell shape firmly clamping between an associated one of said track guides and said support poles respectively.

5. The protective assembly of claim 2, wherein said cover comprises:

a plurality of sleeves concentrically positioned about said support poles respectively; and, a flexible strap located on a leading edge of said cover and thereby enabling a user to manipulate said cover and said support poles along said track guides and into a desired position;

wherein said sleeves run widthwise from side to side on a bottom surface of said cover.

6. A protective assembly for covering a pontoon boat, said protective assembly comprising:

a cover suitably sized and shaped for covering an entire top surface of the pontoon boat;

a track guiding system secured to the top surface of the pontoon boat, said cover being operably coupled to said track guiding system such that a user can readily adapt said cover between extended and retracted positions, said track guiding system comprising:

a plurality of track guides statically mounted to port and starboard handrails of the pontoon boat; and, a plurality of runner assemblies slidably and telescopically adapted along said track guides when said cover is biased to the extended and retracted positions, wherein said runner assemblies remain spaced above the port and starboard handrails of the pontoon boat;

wherein said runner assemblies maintain direct communication with said track guides such that said cover is prohibited from undesirably oscillating along a travel path defined non-parallel to respective longitudinal lengths of said track guides respectively;

wherein said track guide system further comprises:

a plurality of track guide mounts directly coupled to said track guides and the port and starboard handrails respectively; and, a plurality of runner stops directly coupled to opposed ends of said track guides respectively, said runner stops maintaining said track guides statically attached to the port and starboard handrails respectively;

wherein each of said track guides have linear longitudinal lengths extending parallel to the port and starboard handrails respectively;

wherein said track guide mounts are juxtaposed along the longitudinal length of said track guides and extend downwardly therefrom such that said track guide mounts do not interfere with said runner assemblies as said runner assemblies are linearly biased along said track guides.

7. The protective assembly of claim 6, wherein each of said runner assemblies comprises:

a runner cover having a triangular shape provided with opposed corners equidistantly spaced from a center thereof;

a plurality of wheels rotatably coupled to said opposed corners respectively; and, a support pole directly attached to a top one of said opposed corners;

wherein first and second ones of said wheels are directly engaged with a bottom surface of said track guides and a third one of said wheels runs on top of said track guides respectively such that said runner assemblies are prohibited from oscillating along a non-parallel direction to said track guide.

8. The protective assembly of claim 7, wherein each of said support poles has opposed ends directly coupled to a corresponding one of said runner assemblies, said support poles being coextensively shaped and extending along an entire width of the pontoon boat.

9. The protective assembly of claim 7, wherein each of said runner assemblies further comprises:

an anchoring clamp maintaining said cover at a substantially stable position with respect to said track guides, said anchoring clamp having a clamshell shape firmly clamping between an associated one of said track guides and said support poles respectively.

10. The protective assembly of claim 7, wherein said cover comprises:

a flexible strap located on a leading edge of said cover and thereby enabling a user to manipulate said cover and said support poles along said track guides and into a desired position;

wherein said sleeves run widthwise from side to side on a bottom surface of said cover.

11. A method for covering and uncovering a protective assembly on a pontoon boat, said method comprising the steps of:

a. mounting a plurality of track guide mounts to both port and starboard handrails;

b. sizing and attaching a plurality of track guides to said track guide mounts such that said track guides extend parallel to the port and starboard handrails and remain equidistantly spaced apart;

c. rolling a plurality of runner assemblies onto the track guides;

d. installing a plurality of runner stops at fore and aft ends of the track guides;

e. installing a plurality of anchoring clamps at the aft end of said track guides;

f. affixing a cover to a first stationary support pole located at the aft of the pontoon boat;

g. positioning a plurality of sleeves through said first support pole and said anchoring clamps respectively;

h. affixing said cover to remaining ones of said support poles by inserting said remaining support poles into said sleeves; and, i. grasping a strap and walking towards the fore of the pontoon boat to thereby allow said runner assemblies to roll among said track guides and carry said cover over an entire longitudinal length of the pontoon boat.

12. The method of claim 11, further comprising the steps of:

a. grasping the strap and walking from the fore end to the aft end of the pontoon boat to thereby allow said runner assemblies and said cover and said support poles to respectively travel down said track guides and terminate at a stationary end of said apparatus; and, b. securing said cover with a plurality of tie-downs to prevent said cover from unwanted displacement towards the fore end of the pontoon boat.

* * * * *